US006005235A

United States Patent [19]

Shin

[11] Patent Number: 6,005,235

[45] Date of Patent: Dec. 21, 1999

[54] COOLING APPARATUS FOR A MICROWAVE OVEN HAVING LIGHTING LAMPS

[75] Inventor: Sung Un Shin, Changwon, Rep. of Korea

[73] Assignee: LG Electronics, Inc., Seoul, Rep. of Korea

[21] Appl. No.: 09/191,380

[22] Filed: Nov. 13, 1998

[30] Foreign Application Priority Data

Nov. 15, 1997 [KR] Rep. of Korea ..... 97-60246

[51] Int. Cl.[6] ..... H05B 6/80

[52] U.S. Cl. ..... 219/757; 219/685; 219/758; 219/681; 126/21 A

[58] Field of Search ..... 219/757, 756, 219/758, 681, 685; 392/416, 407; 126/21 A

[56] References Cited

U.S. PATENT DOCUMENTS

| | | | |
|---|---|---|---|
| 4,283,614 | 8/1981 | Tanaka et al. | 219/681 |
| 4,477,706 | 10/1984 | Mittelsteadt | 219/681 |
| 4,550,245 | 10/1985 | Arai et al. | 392/416 |
| 4,680,448 | 7/1987 | Lester | 219/365 |
| 4,728,763 | 3/1988 | Bell et al. | 219/685 |
| 5,517,005 | 5/1996 | Westerberg et al. | 219/685 |

FOREIGN PATENT DOCUMENTS

| | | | |
|---|---|---|---|
| 4-295522 | 10/1992 | Japan | 219/758 |

*Primary Examiner*—Philip H. Leung
*Attorney, Agent, or Firm*—Birch, Stewart, Kolasch & Birch, LLP

[57] ABSTRACT

This invention relates to a cooling apparatus for a microwave oven using lighting lamps as a heat source other than microwaves. According to this invention, the microwave oven comprises a pair of lighting lamps set on the upside and downside of a cavity and a pair of cooling fans to supply airflow for cooling the lighting lamps. The airflow by the cooling fan goes towards the inner part of the microwave oven from its outer part, thereby primarily cooling the lighting lamps. In addition, part of the airflow cooling the lighting lamps is exhausted from the microwave oven through the inside cavity of the microwave oven inner air of cavity in harmony.

10 Claims, 3 Drawing Sheets

COOLING APPARATUS FOR A MICROWAVE OVEN HAVING LIGHTING LAMPS

BACKGROUND OF THE INVENTION

1. Field of the Invention

This invention relates to a cooling system for a microwave oven, and more particularly to an apparatus for cooling a microwave oven having lighting lamps inside the cavity.

2. Description of the Prior Art

A microwave generates microwaves out of used electricity. The microwaves imping into a food product, causing molecular motion in the interior product, thus heating the food product. The microwave oven has been widely used for melting frozen food product or heating food products to a desired degree because of its inherent ability to rapidly heat a food product.

However, the microwave oven has some disadvantages caused by its heating method, and it has some limitions caused by its own generating capacity as well. So, it is not altogether appropriate for heating food product. The conventional microwave oven cannot provide a good quality of cooking with rapidity because it uses microwave as its only a heat source; that is the conventional microwave ovens has only show a single way of heating and a limited output of power.

For example, when food products are heated by microwaves, it is done advantageously both internally and externally, but this advantage still turns out to be a comparative disadvantage depending on the food product. Particularly the products like pizza are considered inappropriate to cook in a microwave oven because of its nature. Also, it is pointed out that heating by the microwave oven may also remove too much water from food products.

Relating to that microwave oven's and now in common use, a different type of microwave oven one has been known to make use of a heat source other than microwaves.

However, it is also true that the microwave oven as a heat source does not include various functions as a whole because the heater, even the microwave oven having a heater, functions simply as an additional heat source.

For example, in order to cook products like pizza properly, its crust must be cooked unitl it is crispy in nature but, without driving too much water out of food product. But the microwave oven caused a difficult problem in practical cooking property.

In case of using microwave only as a heat source, several disadvantages are exposed there is; a restriction to a single way of heating by microwaves, a weakness in generating power, and evaporation of water. Also, as stated above, even an additional heater cannot solve those problems in general even when it is mounted inside of the microwave oven.

Unlike conventional microwave ovens as mentioned above, another cooking apparatus, simply using radiant energy of light as a singular heat source, was disclosed in U.S. Pat. No. 5,517,005, dated May 14, 1996, for "visible light and infra-red cooking apparatus" to Westerberg et al. The cooking apparatus has a property heating the inside and outside of food appropriately by impinging high-intensity visible and infrared rays upon the food. Yet, this apparatus does not disclose a cooling fan means capable of regulating the heat of the light. Accordingly, it is necessary to propose a microwave having a cooling system capable of proportionally heating using both light energy and microwaves.

To use lighting lamp as additional heat source, the microwave oven must provide lighting lamps with a high voltage to be able to cook foodstuff within a short time. But, this high voltage lighting lamp generates heat as much as a high voltage, which can heat stuff in a short time. Accordingly, it is necessary to propose an apparatus for cooling the lighting lamp sufficiently. For example, this apparatus for cooling the lighting lamp prevent damage to the lighting lamp and its respective parts. Also, it is necessary to propose the apparatus for cooling the heating part sufficiently.

The conventional microwave oven comprises a magnetron for generating the microwave and a cooling fan for cooling heat generating from a high voltage transformer so as to supply a high voltage to the magnetron.

As above mentioned, in case of mounting the lighting lamp inside the microwave oven, it is impossible for the conventional apparatus to solve the heating problem in relation with lighting lamps.

SUMMARY OF THE INVENTION

The object of this invention is to provide a cooling apparatus for cooling fully a microwave oven having lighting lamps using light energy as a heat source.

The lighting lamp of this invention is installed in the outer side of the upper part and the lower part in the cavity respectively. The first cooling means for cooling the lighting lamp comprises a upper cooling fan and a lower cooling fan so as to cool the lighting lamp installed on the upper part and the lower part in the cavity, respectively.

An additional pair of cooling fans can cool the lighting lamp installed on the upper face and the lower face of the cavity. The airflow made by the upper cooling fan is guided to the upper lighting lamp through a plurality of the duct walls, the airflow passes through the draft grill installed in the front end of the microwave oven. In addition, the airflow passage by the duct walls include an inner intake part for sucking a part of the airflow into cavity and an inner exhaust part for exhausting the airflow from the cavity. The airflow is exhausted to the outside through the inside of cavity. In this way, the airflow by the upper cooling fan can sufficiently to exhaust the inner air in the cavity.

The airflow made by the lower cooling fan comprises a lower duct arranged between the downside of cavity and an outer case of the microwave oven, and a lateral duct arranged between the lateral wall of the cavity and the outer case of the microwave oven. In this way, the airflow made by the cooling fan is guided to the lateral duct and is exhausted to the outside, thereby, the airflow, passing through the lateral duct, cools the lower lighting lamp.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The characteristics and advantage of this invention will become more apparent by describing the preferred embodiments thereof with reference to the accompanying drawings, in which.

DETAILED DESCRIPTION OF THE PREFERRED EMBODIMENT

Figure 1:
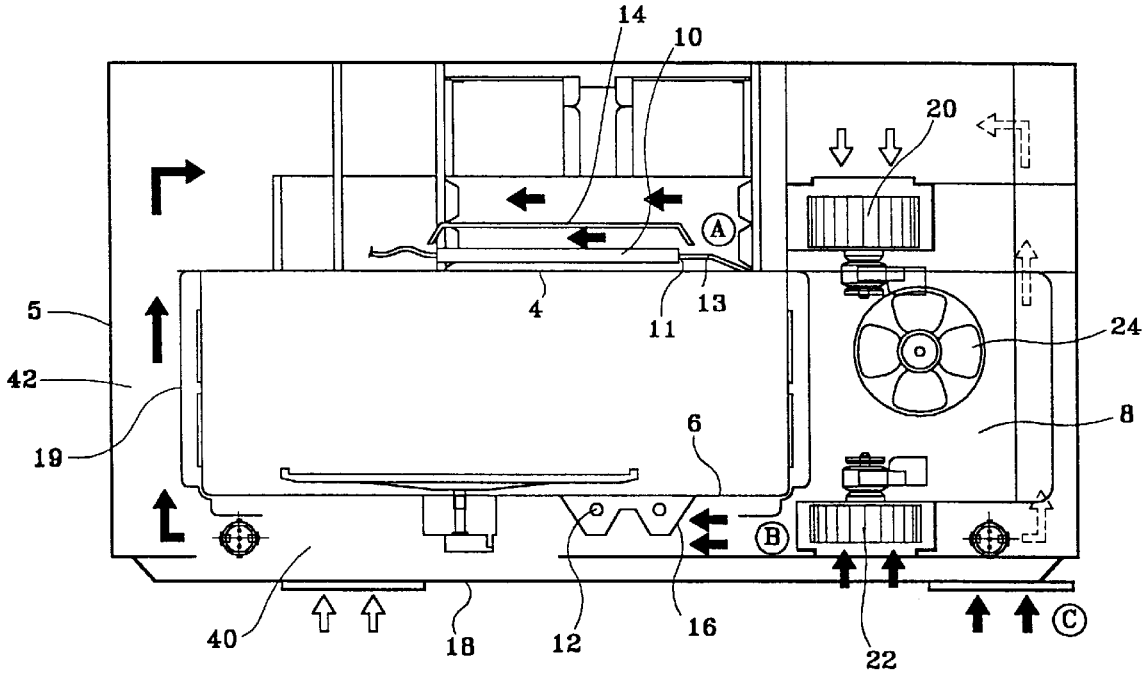
FIG. 1 is a front cross section showing the cooling apparatus of this invention.

FIG.1 shows the cooling apparatus for cooling lighting lamps installed and an additional lighting lamp installed in a microwave oven also called an OTR (Over The Range) oven. The upper lighting lamp 10 and the lower lighting lamp 12, which are a different heat source other than microwaves, are mounted on the upside 4 and downside 6 of cavity. The light generated by the lighting lamps 10, 12 is sucked into the cavity 2 directly or by being reflected by the reflecting plates 14, 16 positioned the outside of the lighting lamps 10, 12.

The cooling fans 20, 22 for cooling heat generated by the lighting lamps 10, 12 are mounted to supply airflow for cooling towards the lighting lamps 10, 12 the cooling fans 20, 22 for cooling the lighting lamps 10, 12 comprise the upper cooling fan 20 mounted to the upper face of the cavity for cooling the lighting lamp 10 mounted to the upper face of the cavity 4 and the lower cooling fan 22 mounted to the lower face of the cavity for cooling the lighting lamp 12 mounted to the lower face of the cavity 6.

The cavity includes a front chamber 8 at one side of cavity and the parts for generating microwaves, such as a high voltage transformers and a magnetron and so on, inside of the front chamber.

Because of heat caused by the high voltage transformer and the magnetron, the cooling fan 24 for cooling heat is mounted to the one side of the front chamber 8, by which the airflow is made. The airflow cools all parts in the cavity, and then exhausts vapor and smoke inside cavity through the exhaust part.

Figure 3:
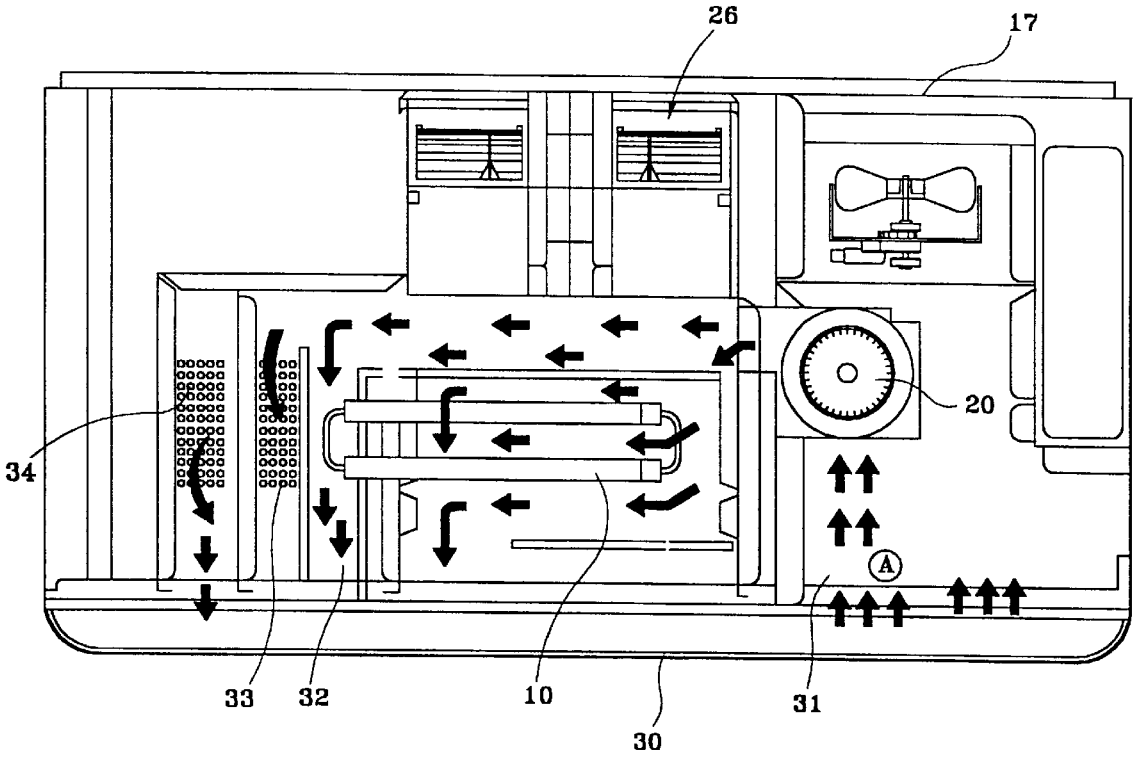
FIG.3 is an upper view showing the cooling apparatus of the invention.

As shown in FIG. 3, an exhaust motor 26 is mounted on the upper back face of the microwave oven called OTR (Over The Range) and exhausts smoke towards the inner part of the microwave oven from its outer part.

And, a draft grill part 30 for exhausting a heating air or smoke made by the gas oven range is mounted on the upper face of the microwave oven called OTR. The draft grill part 30 is mounted on the upside of the microwave oven to pass the air, or may be mounted in the front face or the upper face or in the back face of the microwave oven.

Figure 2:
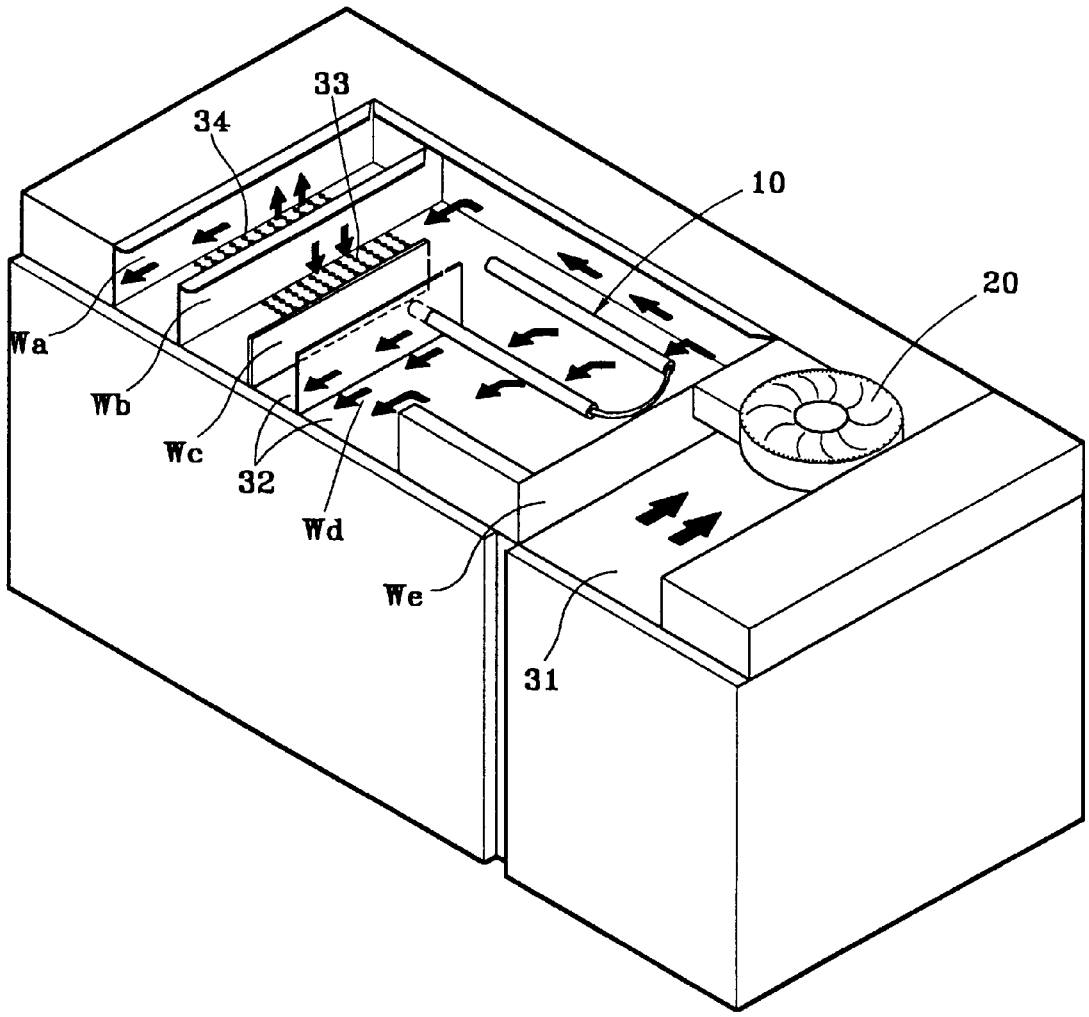
FIG. 2 is a partially cutaway view in perspective of a preferred embodiment of this invention.

As shown in FIG. 2 and FIG. 3, the cooling process by the upper cooling fan 20 is described as follows.

The upper cooling fan 20 intakes the outside air through the intake part 31 of the draft grill part 30 mounted to the front upper end face of the microwave oven and, which exhausts the airflow A toward the upper lighting lamp 10.

The upper cooling fan 20 exhausts the airflow for cooling the upper lighting lamp 10 sufficiently and does not limit sucking of the outside air through the draft grill part 30 mounted in front face of the microwave oven. For example, the cooling fan exhausts the airflow cooling the upper lighting lamp 10 and intakes the airs through the draft grill part.

The airflow made by the upper cooling fan 20 cools the lighting lamp and the its parts through the upper lighting lamp 10. During the upper cooling fan 20 cools the upper lighting lamp 10, the connected part 11 of the cable 13 to supply the power to the upper lighting lamp and the reflecting plate 14 mounted around the upper lighting lamp 10. The part of the airflow cooling the upper lighting lamp 10 is exhausted to the Outside through the exhaust part 32 mounted in the draft grill part 30 as shown in FIG. 2. And, the part of the airflow passes toward the interior of the cavity through the inner intake part 33 having a plurality of the draft holes. Because of supplying the part of the airflow into cavity for exhausting vapor or smoke generated by cavity, the airflow entered inside the cavity comes out through the inner exhaust part having a plurality of the draft holes mounted to the upper face of the cavity. The airflow coming out the cavity 2 through the inner exhaust part 34 is exhausted to the front face of the microwave oven through the draft grill part 30.

The airflow made by the upper cooling fan 20 passes the upper lighting lamp 10 and, is supplied to the interior of the cavity through the inner intake part 33 or is exhausted to the outside of the microwave oven through the exhaust part 34. As above mentioned, the airflow made by the upper cooling fan 20 is guided by a plurality of the duct walls Wa, Wb, Wc, Wd and We arranged to the front of the cavity 2.

The airflow made by the upper cooling fan 20 is guided by the duct wall We to the upper lighting lamp 10. The airflow passes the upper lighting lamp 10 and cools the upper lighting lamp 10 which is guided by the duct walls Wc, Wd and is exhausted to the front face of the microwave oven through the draft grill part 30. The airflow passing inside of the cavity through the inner intake part 33 between the duct wall Wb and Wc is exhausted to the front face of the microwave oven through the draft grill part 30 and the inner exhaust part 34 between the duct wall Wa and the duct wall Wb. The course of the airflow is as follows. The airflow made by the upper cooling fan 20 is guided by the duct walls Wa, Wb, Wc, Wd, and We cooling the upper lighting lamp 10 through the upper lighting lamp 10, is exhausted to the outside of the microwave oven through the draft grill part 30. Or, the airflow enters inside of the cavity 2 and is exhausted to outside of the microwave oven through the draft grill part 30. In this way, the airflow made by the upper cooling fan 20 cools the upper lighting lamp 10 and is exhausted outward through draft grill part of the microwave oven cavity.

As shown in FIG. 1, the lower cooling fan 22 is mounted to the lower part of the front chamber 8 for cooling the lower lighting lamp 12 mounted on the lower face 6 of the cavity 2. Therefore, to intake the air of the outside of the microwave oven, it is composed so that the cooling airflow passes by the lower lighting lamp 12. The airflow made by the lower cooling fan 22 passes between the lower face 6 of the cavity 2 and the lower face 18 of the microwave oven. It defines that the lower duct 40 is a passage arranged between the lower face 6 of the cavity 2 and the lower face 18 of the outer case of the microwave oven.

As shown in FIG. 1, the lower duct 40 is connected to the lateral duct 42 arranged between the lateral wall 5 of cavity 2 and the lateral wall 19 of the outer case of the microwave oven. In this way, the airflow B made by the lower cooling fan 22, passing through the lower lighting lamp 12, as shown by an arrow, and cools the heating part of the lower lighting lamp 12. Of course, the heating part of the lower lighting lamp 12 includes its own lighting lamp and its parts such as the connected part of the power supply in the lamp and the reflecting plate 16 and so on. The airflow cooling the lighting lamp 12 is exhausted outward through the lower duct 40 and the lateral duct 42.

The airflow made by the lower cooling fan 22 moves toward the upper part through the lateral duct 42 arranged between the lateral face 5 of the cavity 2 and the lateral wall 19 of the outer case of the microwave oven. The airflow moving toward the upper part can be exhausted to the front face of the microwave oven through the draft grill part 30, and also be exhausted to the outside through an exhausting course by the exhaust motor 26 as shown in FIG. 3 as in the conventional art. The cooling airflow made by the lower cooling fan 22 may not exhaust just outside through the upper part. For example, another exhaust hole is mounted to the side wall 19 of the outer case opposite to the lower cooling fan 22, and exhausts to the outside the airflow through the exhaust hole. The airflow made by the lower cooling fan 22 is guided to the interior of the cavity 2. Accordingly, it guides the airflow to assist the airflow of the cavity.

Next, the cooling fan 20 is similar to the construction of the conventional cooling fan substantially, which intakes the air from outside of the microwave oven, and cools the parts mounted to the front chamber 8. That is, the cooling fan 20 emits the heat generating from the parts generating the microwave such as magnetron and a high voltage transformer and so on.

The airflow C made by the cooling fan 24 intakes the air from outside through the draft grill part 30 or through the back wall 17 of the microwave oven as shown in FIG. 2. The outside air is sucked into cavity after cooling the parts, such as a magnetron and a high voltage transformer, mounted to the front chamber 8.

By the airflow through inside of cavity 2, it can exhaust the interior air of the cavity 2 outward (vapor or smoke made by the heating process) through the exhaust part 34.

As shown in FIG. 3, the inner exhaust part 34 comprises a plurality of the draft holes mounted in the upper face 4 of the cavity 2 substantially, the draft hole joins the interior of the cavity. An additional draft hole can be formed to the lateral face 5 of the cavity 2, the additional draft hole exhausts outward the airflow sucked into cavity by the cooling fan 24.

The microwave oven called OTR comprises an exhaust motor 26 mounted in the downside of microwave oven to intake the heat and smoke by generating in the microwave oven. The exhaust motor 26 intakes the air of the lower part through the intake part (not shown) arranged to the lower face 18 of the microwave oven.

As shown in FIG. 1, the sucked air is described as C. The draft grill part 30 can be mounted to the front upper face of the microwave oven or to the back face 17 of the microwave oven as well. The sucked air moved by the exhaust motor 26 into the interior of the microwave oven is heat and smoke and is moved to the upper part through the lower duct 40 and the lateral duct 42, and then is exhausted to the outside. Such air, moved to the interior of the microwave oven made by the exhaust motor 26, can be exhausted to outside by the exhaust motor 26 through the conventional course.

According to the conventional course, the airflow moves to the upper part along with the right lateral face of the microwave oven, and thereby is exhausted to the outside of the microwave oven through the back face 17 of the microwave oven or draft grill part 30 of the upper face of the microwave oven like drawn by the dotted line in FIG. 1. Such the exhausted airflow is exhausted to the outside through the hood apparatus mounted in the kitchen.

The microwave oven of this invention includes an additional lighting lamps 10, 12 providing a heat source. For example, the lighting lamps may include a halogen lamp employing radiant energy as visible ray and infrared ray. The lighting lamps 10, 12 are mounted to one side of the cavity 2, and more particularly to the upper face 4 of the cavity 2 and/or the lower face 6 of the cavity. Because the microwave oven provides the light generated by the lighting lamps 10, 12 into the cavity 2 supply, namely because the microwave oven uses the lighting lamps 10, 12 as a heat source, which produces heat by the lighting lamps and the reflecting plates 14, 16. The microwave oven includes the cooling fans 20, 22 for cooling lighting lamps 10, 12. Thus, the airflow by the cooling fans 20, 22 cools the lighting lamp. At this time, because the lighting lamp is also mounted in both ends, connected part 11 of the cable 13 supplying electric current generates a significant amount of heat. So it is desirable to supply the air toward the connected part 11 of cable 13 as much as possible. The part of the airflow made by the cooling fans 20, 22 circulates inside of cavity and is exhausted to the outside.

This invention is to provide to a cooking apparatus such lighting lamps which radiate visible rays, or, infared rays, having a certain wavelength and in proportion to microwaves used as a heat source. In this way, the cooling apparatus cools the heat made by the lighting lamps effectively.

That is say, to cool the lighting lamp effectively, the cooling apparatus includes the airflow made by a plurality of cooling fans toward the upper lighting lamp and the lower lighting lamp. The airflow that cools the lighting lamp is guided to the interior of the cavity, which is exhausted to the outside.

The vapor and smoke generated in the interior of the cavity can be exhausted to outside effectively during the heating process. Accordingly, the microwave oven includes an additional lighting lamp and the reliability of the lighting lamp can be increased, so that this invention provides a microwave oven having longevity and usable for various cooking functions.

The principles preferred embodiment and mode of operation of this invention have been described in the foregoing specification. However, the invention which is intended to be protected is not be construed as limited to the particular embodiment disclosed. The embodiment is to be regarded as illustrative rather than restrictive. Others may make various changes without departing from the spirit of the present invention. Accordingly, it is expressly intended that all such variations and changes which fall within the spirit and scope of the present invention as defined in the claims be embraced thereby.

What is claimed is:

1. A cooling apparatus for a microwave oven having lighting lamps, comprising:

an cavity for putting foodstuff;

a microwave generating and supplying means for generating a microwave and for supplying said microwave into said cavity;

an upper light for supplying light into said cavity, said upper light installed at a upper part of said cavity;

a lower light for supplying light into said cavity, said lower light installed at a lower part of said cavity;

an upper cooling fan for cooling said upper light, said upper cooling fan installed essentially adjacent said upper light;

a lower cooling fan for cooling said lower light, said lower cooling fan installed essentially adjacent said lower light;

an additional cooling means for cooling said microwave generating and supplying means, said additional cooling means positioned in a general location of said microwave generating and supply means; and an air duct means in communication with said upper cooling fan and said lower cooling fan, said air duct means directing an airflow from said upper cooling fan and said lower cooling fan, wherein said airflow cools said upper and lower lights and further supplies an airflow to said cavity.

2. The cooling apparatus for a microwave oven having lighting lamps according to claim 1, wherein said air duct means comprises a upper duct passage disposed directly adjacent said upper light and a lower duct passage disposed directly adjacent said lower light.

3. The cooling apparatus for a microwave oven having lighting lamps according to claim 2, wherein the airflow by said upper cooling fan flows through said upper duct passage and passes the upper light lamp, said airflow exhaustible through a draft grill part installed to an outer face of said microwave oven.

4. The cooling apparatus for a microwave oven having lighting lamps according to claim 3, wherein said upper duct passage includes an inner intake part for sucking a part of the airflow into said cavity and an inner exhaust part for exhausting said airflow from said cavity, said airflow is exhausted toward and through said cavity.

5. The cooling apparatus for a microwave oven having lighting lamps according to claim 2, wherein the air flow by said lower cooling fan flows through said lower duct passage and passes the lower light lamp and is exhaustible through a lateral outer surface of said microwave oven.

6. The cooling apparatus for a microwave oven having lighting lamps according to claim 5, wherein said lower duct passage is further in communication with a side wall exhaust hole, said side wall exhaust hole receiving said airflow from said cavity into said lower duct.

7. The cooling apparatus for a microwave oven having lighting lamps as in claim 1, wherein the airflow by said lower cooling fan is exhausted outward through a lower duct arranged between the downside of said cavity and the outer case of said microwave oven through a lateral duct arranged between the lateral wall of said cavity and the lateral wall of the outer case of said microwave oven.

8. A cooling apparatus for a microwave oven having lighting lamps as in claim 1, the airflow by said upper cooling fan is exhausted outward through an upper duct arranged between the upside of said cavity and the front face of said microwave oven through a duct arranged between the upper wall of said cavity and the upper wall of the outer case of said microwave oven.

9. The cooling apparatus for a microwave oven having light lamps according to claim 1, wherein said light from said upper light and said lower light generates heat proportional to microwaves generated by said microwave generating and supplying means.

10. The cooling apparatus for a microwave oven having light lamps according to claim 1, wherein said upper cooling fan and said lower cooling fan further cool electrical and mechanical parts associated with said upper light and said lower light.

* * * * *